US007372321B2

(12) United States Patent
Krishna et al.

(10) Patent No.: US 7,372,321 B2
(45) Date of Patent: May 13, 2008

(54) ROBUST START-UP CIRCUIT AND METHOD FOR ON-CHIP SELF-BIASED VOLTAGE AND/OR CURRENT REFERENCE

(75) Inventors: Damaraju Naga Radha Krishna, Bangalore (IN); Badrinarayanan Kothandaraman, Banaglore (IN); Sushma Nirmala Sambatur, Banaglore (IN)

(73) Assignee: Cypress Semiconductor Corporation, San Jose, CA (US)

( * ) Notice: Subject to any disclaimer, the term of this patent is extended or adjusted under 35 U.S.C. 154(b) by 33 days.

(21) Appl. No.: 11/509,864

(22) Filed: Aug. 25, 2006

(65) Prior Publication Data

US 2007/0139029 A1 Jun. 21, 2007

Related U.S. Application Data

(60) Provisional application No. 60/726,101, filed on Oct. 11, 2005.

(51) Int. Cl.
*G05F 1/10* (2006.01)
*G05F 3/02* (2006.01)

(52) U.S. Cl. ..... 327/541; 327/198; 327/538; 327/539; 327/543; 323/313; 323/315; 323/901

(58) Field of Classification Search ..... 327/142, 327/143, 198, 538–543; 323/312–317, 901
See application file for complete search history.

(56) References Cited

U.S. PATENT DOCUMENTS 5,565,811 A 10/1996 Park et al.
5,642,037 A * 6/1997 Malherbe ..... 323/316
5,949,227 A * 9/1999 Bujanos ..... 323/313
5,955,873 A * 9/1999 Maccarrone et al. ..... 323/314
6,163,206 A * 12/2000 Kobayashi ..... 327/540
6,201,436 B1 * 3/2001 Hur et al. ..... 327/543
6,335,614 B1 1/2002 Ganti
6,894,473 B1 * 5/2005 Le et al. ..... 323/314
7,034,514 B2 * 4/2006 Tachibana et al. ..... 323/313
7,199,644 B2 * 4/2007 Fujimoto ..... 327/538

OTHER PUBLICATIONS

U.S. Appl. No. 11/653,533, Rao et al.
U.S. Appl. No. 60/798,064, Vispute et al.

* cited by examiner

*Primary Examiner*—Tuan T. Lam
*Assistant Examiner*—Patrick O'Neill
(74) *Attorney, Agent, or Firm*—Haverstock & Owens, LLP

(57) ABSTRACT

A reference circuit can include a reference section that provides a reference value for other circuits of an integrated circuit and can be enabled and disabled in response to an enable signal. The reference circuit can include at least a first node, draw a reference current in the enabled mode, and draw essentially no current in the disabled mode. A pulse start-up section can provides a low impedance path between the first node and a first potential for a predetermined duration in response to the reference circuit being enabled. A continuous start-up section can provide a low impedance path between the first node and the first potential based on a logic state of an enable signal.

20 Claims, 4 Drawing Sheets

ROBUST START-UP CIRCUIT AND METHOD FOR ON-CHIP SELF-BIASED VOLTAGE AND/OR CURRENT REFERENCE

This application claims the benefit of U.S. provisional patent application Ser. No. 60/726,101, filed Oct. 11, 2005, the contents of which are incorporated by reference herein.

TECHNICAL FIELD

The present invention relates generally to integrated circuit devices that include self-biased voltage or current reference circuits, and more particularly to start-up circuits for such reference circuits having active and inactive modes of operation.

BACKGROUND OF THE INVENTION

In many integrated circuit designs it can be desirable to provide a reference circuit. A reference circuit can provide a current and/or voltage at a generally known value. Reference circuits can have numerous applications, including but not limited to establishing a reference voltage to detect input signal levels, establishing a lower supply voltage to some section of a larger integrated circuit (e.g., memory cell array), establishing a reference voltage/current to determine the logic value stored in a memory cell, establishing a threshold voltage for some other function.

Reference circuits can be non-biased or self-biased. Non-biased reference circuits can rely on discrete voltage drop devices to arrive at a reference level. For example, a non-biased reference circuit can include resistor-diode (or diode connected transistor) arranged in series between a high supply voltage and a low supply voltage. A drawback to such approaches can be that a current drawn can be proportional to supply voltage. Thus, a higher supply voltage can result in a higher device current (ICC). This can be undesirable for low power applications.

Self-biased reference circuits can rely on transistor biasing to provide a reference current that is less variable in response to changes in power supply voltage. Self-biased reference circuits almost always operate in conjunction with a start-up circuit. A start-up circuit can help establish potentials at particular nodes in a power up (or similar operation) in order to ensure that the reference circuit is operating properly. A drawback to conventional self-biased circuits can be that start-up current paths are never shut-off. Thus, such start-up circuits will continue to draw current irrespective of operational mode. This forces the startup current to be relatively low in order to consume low power and hence limits the speed of a start-up operation.

Reference circuits can also be passive or active. A passive reference circuit can remain in the same state regardless of the integrated circuit device mode. Thus, a passive reference circuit can provide a same reference current while power is applied to the corresponding integrated circuit. Such an arrangement can be undesirable in low power devices or require relatively large amounts of device area. For example, while a reference current magnitude can be reduced by employing large resistors, such large resistors can consume a large amount of area and require additional circuitry to generate a larger, more usable current magnitude (i.e., current multipliers).

An active reference circuit can be placed in an enabled mode, in which the reference circuit can provide a reference value at a more practical level (i.e., a reference current that does not require undue multiplication to arrive at a usable level). However, in a disable mode, the reference circuit can be placed into a state that draws essentially no current. Such an arrangement can help reduce current by placing the reference circuit in the disabled mode when not in use.

To better understand various features of the present invention, a conventional reference circuit with corresponding start-up circuitry will now be described. The conventional example represents a "DC" startup circuit that can place a reference circuit in an inactive or active mode based on the logic state of a mode signal (in this case a chip enable signal) and a reference potential.

FIG. 5 shows a conventional reference circuit designated by the general reference character 500. A reference circuit 500 can include an active bias reference stage 502 and a start-up circuit 504. Reference stage 502 can operate in an enabled mode or disabled mode. In an enabled mode, reference stage 502 can draw a current $I_{REF}$ and $I_{MIRR}$. Such currents can provide a reference value for an integrated circuit either directly or indirectly (e.g., via further current mirroring). In a disabled mode, disable device N53 can be turned on, pulling Node2 to a low supply voltage VGND, turning off n-channel devices (N51 and N52), and thus stopping the generation of currents $I_{REF}$ and $I_{MIRR}$.

A start-up circuit 504 can include a sensing leg 506, a pull-up leg 508 and a pull-down leg 510. A sensing leg 506 can determine when a reference stage 502 has achieved a start-up state. Once such a determination has been made, a sensing leg 506 can disable the pull-up leg 508 and pull-down leg 510.

In more detail, initially, a chip enable (CE) signal can be at an inactive level (low). In such a condition, signals CEB/CEB2 can be high, while signal CE2 can be low. As noted above, within reference stage 502 disable device N53 can pull Node2 to a ground, disabling current mirror N51/N52, and thus preventing current from being drawn by reference stage 502. Within pull-up stage 508, device P53 can be turned off by signal CEB2, disabling the pull-up path. Similarly, within pull-down stage 510, device N56 can be turned off by signal CE2, disabling the pull-down path. Within sensing leg 506, with Node2 pulled low, device N59 can be turned off, disabling the sensing leg 506.

A device can enter a start-up state by the CE signal transitioning from the inactive level (low) to an active level (high). Signals CEB/CEB2 will transition from high to low, while signal CE2 can transition from low to high. Within reference stage 502, device N53 can be turned off, enabling current mirror N51/N52. Within pull-up stage 508, device P53 can be turned on by signal CEB2, enabling the pull-up path through device N54. Within pull-down stage 510, device N56 can be turned on by signal CE2, enabling the pull-down path through device N57. Thus, Node1 can begin to discharge, while Node2 can begin to charge.

Within sensing leg 506, device N58 can receive a voltage Vlimit at its gate. This can limit the pull-up potential at the source of device N58. Further, device P54 can receive the potential at Node2 at its gate. As a result, an intermediate voltage Vctrl can be generated at Node3.

As the start-up operation proceeds, the potential at Node2 can continue to rise eventually turning on N59 and turning off P54. Thus Vctrl will be switched to VGND eventually, due to the potential Vctrl applied to the gate of device N54, pull-up leg 508 can be disabled, and the pull-up operation at Node2 can cease. Similarly, as the start-up operation proceeds, the potential at Node1 can continue to fall. Eventually, due to the potential Vctrl applied to the gate of device N57 and Vlimit applied to the gate of NV55, the pull-down operation at Node1 can cease. Ideally, the reference stage 502 is operating in a nominal fashion, having switched from a disabled mode to an enabled mode.

While a conventional arrangement like that of FIG. 5 can provide a start-up circuit that can be disabled, such a circuit can have some drawbacks. First, the operation of the circuit can depend on the control bias voltages Vlimit to work properly. Second, such a circuit may have a minimum CE signal disable time. More particularly, when the CE (and CEB) signal goes to a disabled level, it may take some time for Vctrl to reach the Vlimit level. This time period can be considered a "minimum disable time". If the CE (and CEB) signal goes to an enabled level before such a "minimum disable time", the circuit may fail to properly initialize Node1 and Node2, and the reference stage 502 will fail to operate properly.

DETAILED DESCRIPTION

Various embodiments of the present invention will now be described in detail with reference to a number of drawings. The embodiments show circuits and methods that can enable and disable a reference circuit on start-up and related operations. Further, such embodiments can essentially eliminate a minimum disable time as compared to conventional approaches.

Figure 1:
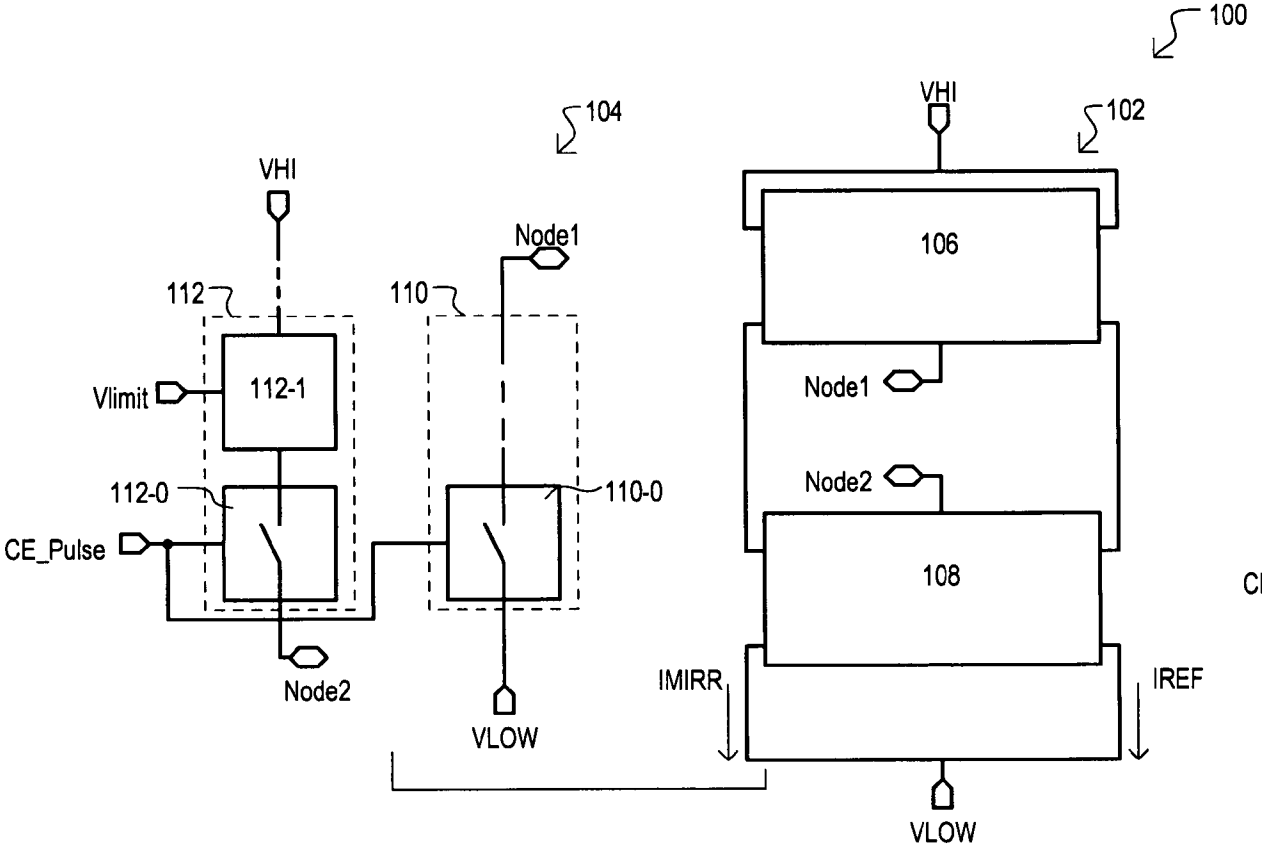
FIG. 1 is a block schematic diagram of a circuit according to a first embodiment of the present invention.

A circuit according to a first embodiment is set forth in FIG. 1, and designated by the general reference character 100. Preferably, a circuit 100 comprises or forms part of an integrated circuit device having active circuit elements formed in the same substrate. Further, a circuit may preferably work in tandem with a "DC" type startup circuit. One example of such a DC type startup circuit can be that shown as 506, 508 and 510 in FIG. 5.

A circuit 100 can include a reference circuit 102 and a start-up circuit 104. A reference circuit 102 can include a first section 106 that includes a first node (Node1) and a second section 108 and a second node (Node2). Reference circuit 102 can be placed in either an enabled state or a disabled state according to a potential applied at Node1 and Node2. In an enabled state, reference circuit 102 can provide reference values for use by other circuits. In the very particular example of FIG. 1, when active, a reference circuit 102 can provide a reference current $I_{REF}$ and corresponding mirror current $I_{MIRR}$. When disabled, little or essentially no current can be drawn by reference circuit 102.

A start-up circuit 104 can provide potentials to Node1 and Node2 that can result in reference circuit 102 being disabled in an inactive mode and enabled in an active mode. A start-up circuit 104 can include a pull-down path 110 and a pull-up path 112. A pull-down path 110 can be situated between Node1 and a low potential $V_{LOW}$. A pull-up path 112 can be situated between Node2 and a high potential $V_{HI}$.

Figure 5:
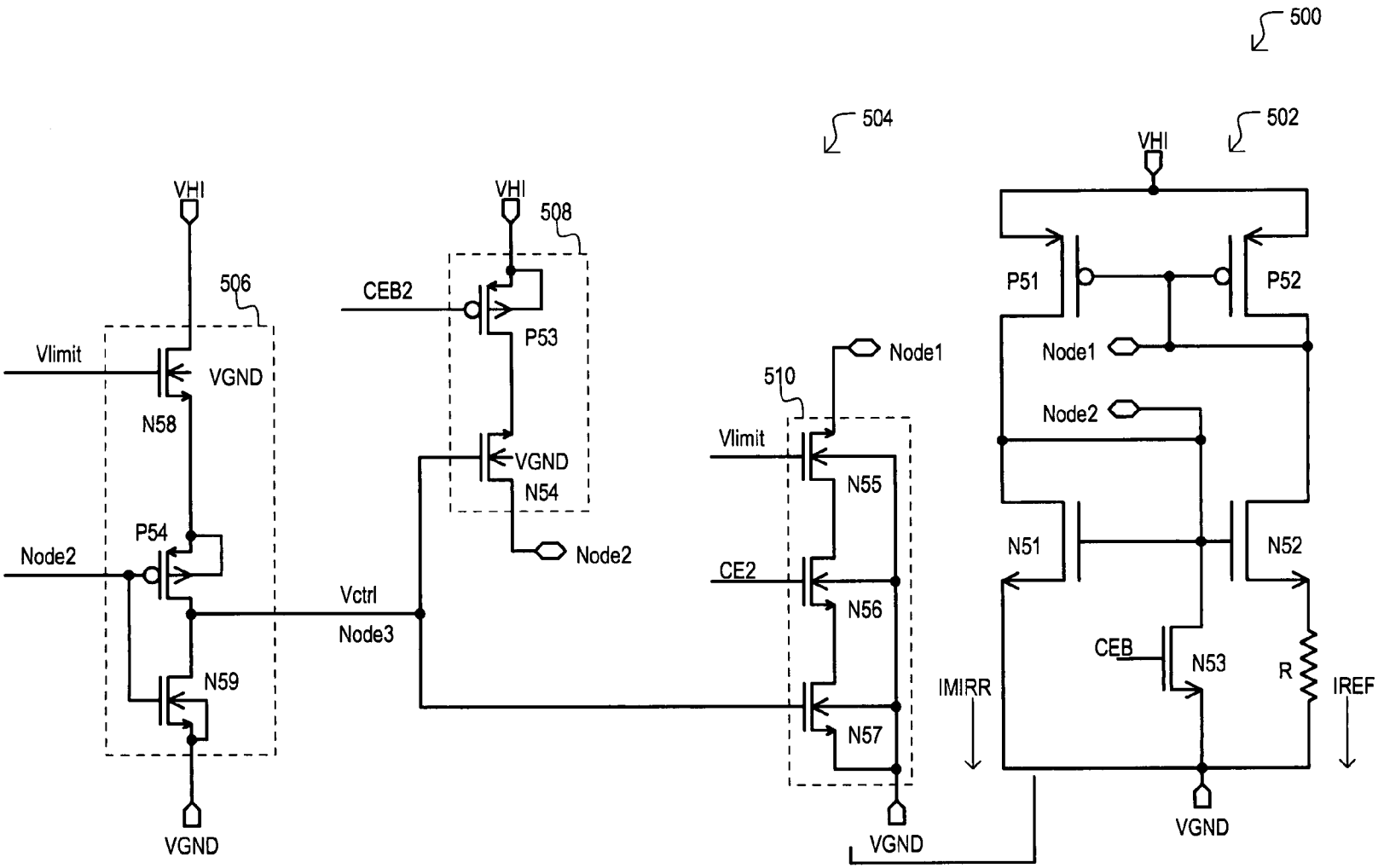
FIG. 5 (BACKGROUND ART)
FIG. 5 is a block schematic diagram showing a conventional start-up and reference circuit.

Unlike conventional arrangements like that of FIG. 5, a start-up circuit 104 can be activated according to a pulse signal generated when the circuit transitions from an inactive mode to an active mode. In the very particular example shown, such a signal includes a chip enable pulse signal (CE_Pulse) that can be generated in response to a chip enable signal (CE) signal transitioning from an inactive level to an active level.

A pull-down path 110 can include a first pulsed gate circuit 110-0 that can enable a discharge path in response to the CE_Pulse signal. Thus, Node1 can be rapidly pulled toward an enable level upon start-up, to place reference circuit 102 in an active mode at a relatively fast speed, as compared to conventional approaches.

In the particular example of FIG. 1, a pull-up path 112 can include a second pulsed gate circuit 112-0 that can enable a charge path in response to the CE_Pulse signal. Thus, Node2 can also be rapidly pulled toward an enable level upon start-up, to place reference circuit 102 in an active mode at a relatively fast speed. A pull-up path 112 can also include a voltage limit circuit 112-1 that can limit the level to which Node2 can rise, thus ensuring Node2 does rise to an overly high level.

In this way, by utilizing a pulsed signal, a start-up circuit 104 can place a reference circuit 102 into an enabled state at a relatively fast speed. Such an arrangement can result in a circuit 100 that does not suffer from a "minimum disable time", like the conventional arrangement of FIG. 5. At the same time, a corresponding DC startup circuit (not shown) can provide a startup and regulation response for the reference circuit 102, as well.

Figure 2A:
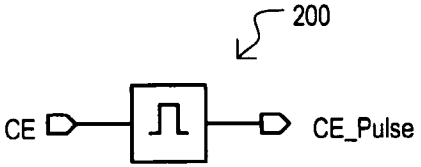
FIG. 2A is a block schematic diagram showing the generation of a pulse signal according to an embodiment.
Figure 2B:
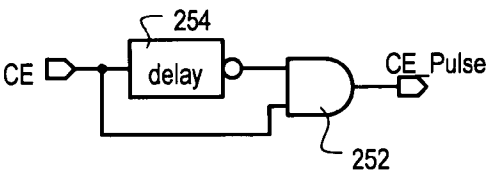
FIG. 2B is a schematic diagram showing the generation of a pulse signal according to another embodiment.

Referring now to FIGS. 2A and 2B, two examples of pulse generating circuits are shown in block and schematic diagrams. As shown in FIG. 2A, a pulse generating circuit 200 can generate a pulse CE_Pulse in response to a chip enable (CE) signal. More particularly, a pulse CE_Pulse can rise to an active level for a predetermined amount of time in response to the CE signal transitioning from an inactive level to an active level.

FIG. 2B shows one very particular example of a pulse generating circuit 250 that can generate a pulse in response to a CE signal transitioning from a low level to a high level. In the example shown, pulse generating circuit 250 can include an AND gate 252 and inverting delay circuit 254. A chip enable signal CE can be applied to a first input of AND gate 252 and to an input of delay circuit 254. An output of delay circuit 254 can be applied to a second input of AND gate 252. In one very particular embodiment, a resulting pulse duration can be 5-10 ns established according to delay circuit 254.

Of course the above represent but two of the many possible pulse generating circuits that can be utilized to generate a CE_Pulse signal, and so should not be construed as limiting to the invention.

Figure 3:
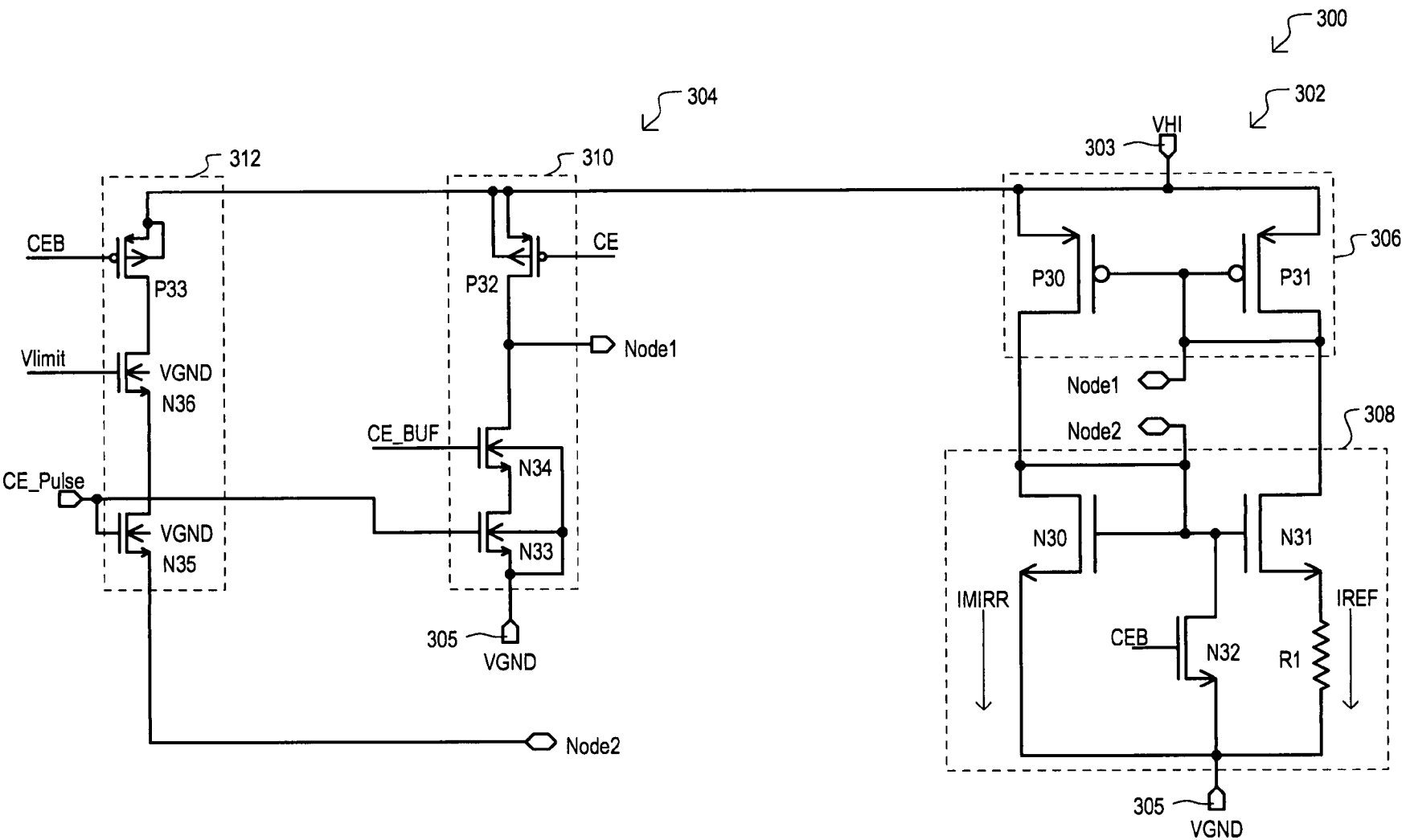
FIG. 3 is a schematic diagram of a circuit according to a second embodiment of the present invention.

Referring now to FIG. 3, a circuit according to a second embodiment is set forth in FIG. 3, and designated by the general reference character 300. As in the case of the first embodiment 100, preferably, a circuit 300 comprises or forms part of an integrated circuit device having active circuit elements formed in the same substrate. Further, as in the case of the embodiment of FIG. 1, a circuit 300 may preferably work in tandem with a DC type startup circuit.

A circuit 300 can include a reference circuit 302 and a start-up circuit 304. A reference circuit 302 can include a first section 306 and a second section 308. A first section 306 can include a current mirror formed by two p-channel insulated gate field effect transistors (e.g., MOSFETs) P30 and P31, as well as a node (Node1). Transistors P30 and P31 can have sources commonly connected to a high power supply node 303 and gates commonly connected to Node1. Operation of the current mirror can be controlled according to biasing at Node1. In particular, current mirror P30/P31 can be disabled by pulling Node1 to a high supply ($V_{HI}$) voltage level, and then enabled by pulling Node1 to a lower voltage. When current mirror P30/P31 is disabled, reference circuit 302 can draw essentially no current.

A second section 308 can include n-channel transistors N30, N31 and N32, resistor R1, and a node Node2. Transistors N30 and N31 can form a current mirror that can be enabled and disabled according to a potential at Node2. Transistors N30 and N31 can have sources commonly connected to a low power supply node 305 and gates commonly connected to Node2. In such an arrangement, current mirror N30/N31 can be disabled by pulling Node2 to a voltage level VGND, and then enabled by pulling Node2 to a higher voltage. Transistor N32 can provide such a disabling function. Transistor N32 can have a source-drain path connected between Node2 and a low power supply node 305, and a gate that receives chip enable signal CEB. Thus, when signal CEB is high, transistor N32 can connect Node2 to a low power supply voltage VGND. Resistor R1 can limit the amount of current drawn ($I_{REF}$ and $I_{MIRR}$) by reference circuit 302 when in the active state and/or establish a desired biasing level for the reference circuit 302.

A start-up circuit 304 can include a pull-down path 310 and a pull-up path 312. In the very particular example of FIG. 3, a pull-down path 310 can include n-channel transistors N33, N34, and p-channel transistor P32. Transistor P32 can have a source connected to high power supply node 303. Transistor N34 can have a drain connected to the drain of transistor P32. Transistor N33 can have a drain connected to the source of transistor N34 and a source connected to a low power supply node 305.

A Node1 can be connected at the drain-drain connection between transistors N34 and P32. Transistor N33 can be a pulse enabled transistor, transistor N34 can be enabled in response to a buffered chip enable signal CE_BUF, and transistor P32 can be enabled in response to a chip enable signal CE.

In a disabled mode, signals CE and CE_BUF can be low. Consequently, transistor N34 can be turned off, while transistor P32 is turned on. As a result, Node1 can be isolated from a low potential VGND, and pulled to a high potential $V_{HI}$. This can rapidly turn off current mirror P30/P31 in reference circuit 302, thus helping to place the entire circuit 300 in the disabled mode, and prevent an undesirably long "minimum disable time".

Conversely, in an enabled mode, signals CE and CE_BUF can be high. Consequently, transistor N34 can be turned on, while transistor P32 is turned off. As a result, Node1 can be isolated from the high potential $V_{HI}$. Further, when transistor N33 is turned on by pulse signal CE_Pulse, Node1 can be temporarily connected to a low potential VGND, thus rapidly enabling current mirror P30/P31.

In this way, a start-up circuit 304 can include a pull-down path 310 that can rapidly enable one or more sections within a reference circuit in response to a signal pulse. This is in contrast to the gradual DC operation described in the conventional example of FIG. 5.

Referring still to FIG. 3, in the particular example shown, a pull-up path 312 can include n-channel transistors N35, N36 and p-channel transistor P33. Transistor P33 can have a source connected to high power supply node 303. Transistor N36 can have a drain connected to the drain of transistor P33. Transistor N35 can have a drain connected to the source of transistor N36. Node2 can be connected at the source of transistor N35. Transistor N35 can be a pulse enabled transistor, transistor N36 can receive a limiting voltage Vlimit, and transistor P32 can be enabled in response to an inverse chip enable signal CEB.

In a disabled mode, signals CEB can be high. Consequently, transistor P33 can be turned off. As a result, Node2 can be isolated from high potential $V_{HI}$. Further, as noted before, transistor N32 within reference circuit can pull Node2 to low potential VGND. This can rapidly turn off current mirror N30/N31 in reference circuit 302, thus helping to place the entire circuit 300 in the disabled mode, and also prevent an undesirably long "minimum disable time".

In an enabled mode, signal CEB can be low. Consequently, transistor P33 can be turned on. When transistor N35 is turned on by CE_Pulse, Node2 can be temporarily connected to a high potential $V_{HI}$, via transistors N36 and P33, thus rapidly enabling current mirror N30/N31. Potential Vlimit at the gate of N36 can provide a limit to how high Node2 can rise.

In this way, a start-up circuit 304 can also include a pull-up path 312 that can rapidly enable one or more sections within a reference circuit in response to a signal pulse.

As noted above, a pulse enabled approach, such as that shown in the above disclosed embodiments, can be combined with conventional "DC" approaches like those shown in FIG. 5. One such arrangement is shown in FIG. 4.

Figure 4:
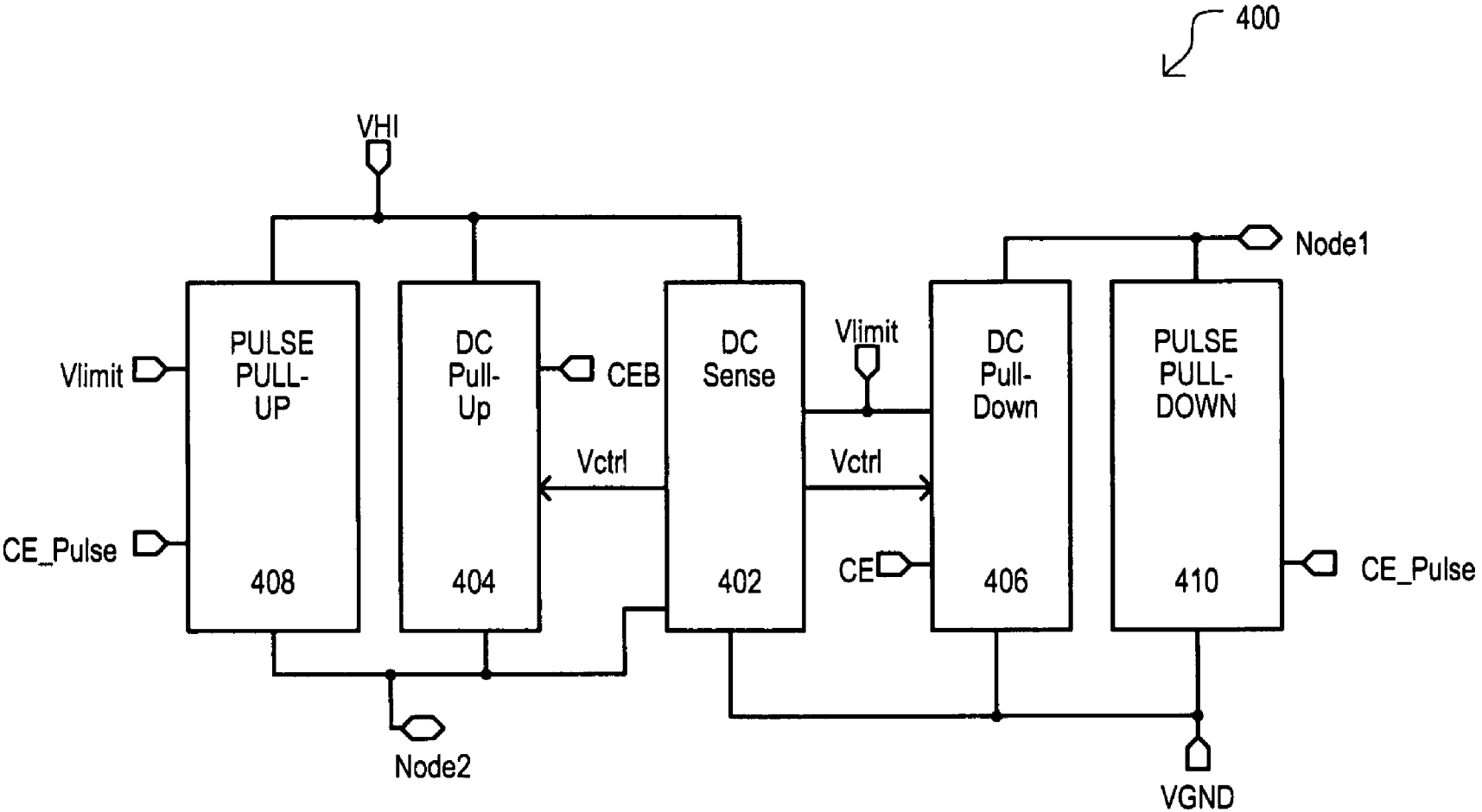
FIG. 4 is a block schematic diagram of a third embodiment of the present invention.

FIG. 4 shows a start-up circuit 400 that includes both pulse enable and DC enable approaches. In the example shown, start-up circuit 400 includes a DC sense circuit 402, a DC pull-up path 404, and a DC pull-down path 406. Such circuit sections can be conventional start-up circuits. In particular, DC sense circuit 402, DC pull-up path 404, and DC pull-down path 406, can operate in the same general fashion or be essentially the same as sensing leg 506, a pull-up leg 508, and a pull-down leg 510, respectively, of FIG. 5.

However, in addition, a start-up circuit 400 can include a pulsed pull-up path 408 and pulsed pull-down path 410. A pulsed pull-up path 408 can operate in the same general fashion or be essentially the same as pull-up path 112 of FIG. 1 and/or 312 of FIG. 3. Similarly, pulsed pull-down path 410 can operate in the same general fashion or be essentially the same as pull-down path 110 of FIG. 1 and/or 310 of FIG. 3.

Thus, in an arrangement like that of FIG. 4, in a disabled mode all pull-up paths, both pulsed and DC, can be disabled. Similarly, all pull-down paths, both pulsed and DC, can be disabled. In an enabled mode, pulsed pull-up and pulsed pull-down paths (408 and 410) can rapidly place Node1 and Node2 to an enable potential, and then turn off, once the activating pulse has fallen. DC pull-up and pull-down paths (404 and 406) can continue to operate in the manner described in conjunction with FIG. 5, to maintain Node1 and Node2 in a desired operating range. If only pulsed startup is used, startup phenomenon is one-time event in a CE disable to enable cycle. But, a DC startup, like that shown in FIG. 5, is a continuous phenomenon, since it keeps a watch over the nodes "node1" and "node2". Thus, DC startup paths in conjunction with pulsed startup paths can eliminate "minimum CE disable time", a shortcoming of the "only DC startup paths". Hence both startup paths operating in tandem is a preferred implementation.

It is understood that the embodiments of the invention may be practiced in the absence of an element and or step not specifically disclosed. That is, an inventive feature of the invention can be elimination of an element.

Accordingly, while the various aspects of the particular embodiments set forth herein have been described in detail, the present invention could be subject to various changes, substitutions, and alterations without departing from the spirit and scope of the invention.

What is claimed is:

1. An integrated circuit device having a reduced power mode established by an enable signal, comprising:

a self-biased reference circuit that provides a reference value to the integrated circuit, the reference circuit being disabled in the reduced power mode and having a first node;

a pulse start-up circuit that includes a first start-up current path coupled between the first node and a first predetermined potential, the first start-up current path including first device having a current path enabled in response to an enable pulse signal, the enable pulse signal being activated in response to a predetermined transition in the enable signal; and a continuous start-up circuit that includes at least one continuous start-up circuit path that provides a low impedance path between the first node and the first predetermined potential in response to a predetermined logic state of the enable signal.

2. The integrated circuit device of claim 1, further including:

the enable signal is a chip enable (CE) signal; and a pulse generating circuit that receives the CE signal and activates the enable pulse signal in response to the CE signal transitioning from an inactive state to an active state.

3. The integrated circuit device of claim 1, wherein:

the first start-up current path is a pull-down path and the first predetermined potential is a low supply potential, the first start-up current path including a second device in series with the first device having a current path enabled in response to the enable signal.

4. The integrated circuit device of claim 3, further including:

a first node disable device coupled between the first node and a high supply node of the reference circuit, the first node disable device providing a low impedance path in response to the enable signal establishing the low power mode.

5. The integrated circuit device of claim 4, wherein:

the first device includes a first n-channel transistor;

the second device includes a second n-channel transistor; and the first node disable device includes a p-channel transistor; wherein the source-drain path of the first n-channel transistor, second n-channel transistor and p-channel transistor being arranged in series with one another.

6. The integrated circuit device of claim 1, wherein:

the self-biased reference circuit includes a first current mirror circuit comprising at least two p-channel mirror transistors having source-drain paths arranged in parallel with one another and commonly connected gates, the gate of one of the p-channel mirror transistors being coupled to its source.

7. The integrated circuit device of claim 6, further including:

the self-biased reference circuit further including a second node;

the first start-up current path is a pull-down path; and a pull-up current path coupled between the second node and a reference circuit high potential supply node, the pull-up current path including a pull-up device having a current path enabled in response to the enable pulse signal.

8. The integrated circuit device of claim 7, further including:

a pull-up disable device that provides a high impedance path between the second node and the reference circuit high supply potential when the second node reaches a predetermined potential that is greater than the low supply potential and less than the reference circuit high supply potential.

9. The integrated circuit device of claim 1, wherein:

the first start-up current path is a pull-up path and the first predetermined potential is a reference circuit high supply potential, the first start-up current path including a second device in series with the first device having a current path enabled in response to the enable signal.

10. A reference circuit, comprising:

a reference section that provides a reference value for other circuits of an integrated circuit, the reference circuit being enabled and disabled in response to an enable signal, the reference circuit having at least a first node, and drawing a reference current in the enabled mode, and essentially no current in the disabled mode; and a pulse start-up section that provides a low impedance path between the first node and a first potential for a predetermined duration in response to the reference circuit being enabled; and a continuous start-up section that provides a low impedance path between the first node and the first potential based on a logic state of an enable signal.

11. The reference circuit of claim 10, wherein:

the reference section includes a second node; and the pulse start-up section provides a low impedance path between the second node and a second potential for a second predetermined duration in response to the reference circuit being enabled, the first potential being different than the second potential.

12. The reference circuit of claim 11, wherein:

the first predetermined duration is essentially the same as the second predetermined duration.

13. The reference circuit of claim 11, wherein:

the reference section includes a first current mirror circuit that include a first current mirror transistor and second current mirror transistor having current paths arranged in parallel to one another, and each including a control node commonly connected to the first node, and a second current mirror circuit that include a third current mirror transistor and a fourth current mirror transistor having current paths arranged in parallel to one another, and each including a control node commonly connected to the second node.

14. The reference circuit of claim 11, wherein:

the pulse start-up section includes a first transistor having a current path coupled between the first node and the first potential, and a second transistor having a current path coupled between the second node and the second potential and a control node coupled to the control node of the first transistor.

15. The reference circuit of claim 14, wherein:

the pulse start-up circuit further includes a third transistor having a current path in series with the current path of the first transistor, the third transistor receiving a control value at its control terminal that limits a potential at the current path of the first transistor to less than the first potential, and a fourth transistor having a current path in series with the current path of the second transistor, the fourth transistor providing a low impedance current path when the reference circuit is in the enabled mode.

16. A method of switching a reference circuit between a disabled mode and an enabled mode, comprising the steps of:

in the disabled mode, coupling a first reference node to a first supply node to disable first reference transistors and coupling a second reference node to a second supply node to disable second reference transistors; and when switching from the disabled mode to the enabled mode, generating a pulse and coupling the first reference node to the second supply node via a first current path according to the pulse, and coupling the second reference node to the first supply node via a second current path according to the pulse.

17. The method of claim 16, wherein:

the reference circuit is part of an integrated circuit that is placed in the enabled mode or disabled mode in response to a chip enable (CE) signal; and the pulse is generated in response to the CE signal transitioning from a disabling state to an enabling state.

18. The method of claim 16, wherein:

in the disabled mode, coupling a first reference node to a first supply node includes coupling commonly connected gates of a first current mirror formed with p-channel transistors to a high power supply node of the reference circuit, and coupling a second reference node to a second supply node includes coupling commonly connected gates of a second current mirror formed with n-channel transistors to a low power supply node.

19. The method of claim 16, further including:

in the enabled mode disabling the first current path and the second current path after the pulse duration is over.

20. The method of claim 16, further including:

when switching from the disabled mode to the enabled mode, the first current path discharges the first node and the second current path charges the second node, and limiting the potential of the second node to a predetermined reference potential that is greater than a potential received at the second supply node and less than a potential received at the first supply node.

* * * * *